US005313892A

United States Patent [19]

Tice

[11] Patent Number: 5,313,892

[45] Date of Patent: May 24, 1994

[54] TABLE WITH HEIGHT AND TILT ADJUST

[76] Inventor: William A. Tice, 6711 Maynardville Hwy., Knoxville, Tenn. 37918

[21] Appl. No.: 781,483

[22] Filed: Oct. 21, 1991

[51] Int. Cl.[5] ..... A47B 9/00

[52] U.S. Cl. ..... 108/147; 108/7

[58] Field of Search ..... 108/147, 146, 144, 1, 108/7, 10, 50, 9; 297/423, 438, 439; 248/188.2, 188.5

[56] References Cited

U.S. PATENT DOCUMENTS

| | | | |
|---|---|---|---|
| 63,633 | 4/1867 | Haworth . | |
| 149,255 | 3/1874 | Semmendinger . | |
| 540,434 | 6/1895 | Gilfillan . | |
| 709,612 | 9/1902 | Smith . | |
| 2,646,322 | 7/1953 | Laxo . | |
| 2,857,225 | 10/1958 | Dombek . | |
| 3,012,363 | 12/1961 | Sautereau . | |
| 3,080,835 | 3/1963 | Guglielmi | 108/147 X |
| 3,358,620 | 12/1967 | Parigi . | |
| 3,370,556 | 2/1968 | Kooi | 108/10 X |
| 3,543,282 | 11/1970 | Sautereau . | |
| 3,643,604 | 2/1972 | Jones et al. . | |
| 3,828,694 | 8/1974 | Nestler | 108/10 |
| 4,381,714 | 5/1893 | Henneberg et al. | 108/147 |
| 4,440,096 | 4/1984 | Rice et al. | 108/7 X |

FOREIGN PATENT DOCUMENTS

| | | | |
|---|---|---|---|
| 2164943 | 7/1973 | Fed. Rep. of Germany | 108/147 |

*Primary Examiner*—Jose V. Chen

*Attorney, Agent, or Firm*—Luedeka, Hodges, Neely & Graham

[57] ABSTRACT

A pneumatic table that adjusts to various positions. Pneumatic cylinders controlled by a pneumatic system raise and lower the tabletop to a desired position. Brakes are used to lock the tabletop once it is in its desired position. The tabletop tilts forward and backward to vary the operating position of a piece of machinery located on the tabletop. A self-adjusting foot treadle adjusts when the tabletop height is changed such that the linkage between the treadle and the tabletop is maintained. The treadle also adjusts to various positions for the comfort of the operator.

3 Claims, 10 Drawing Sheets

TABLE WITH HEIGHT AND TILT ADJUST

BACKGROUND OF THE INVENTION

The present invention relates to adjustable tables and, more specifically, to height adjustable tables used in factories where machinery is located on the tables.

There have been several attempts to provide an adjustable table that can be used in industry where a continuous repetitive movement by a worker is needed in operating a piece of machinery. This continuous repetitive movement can cause injury, and tables that adjust in height and tilt vary this repetitive movement to help reduce injury.

One known adjustable table provides a mechanical means of adjusting the height and the tilt of the tabletop. This type table generally has a hand operated crank to adjust the height and tilt. These manual adjustments can be difficult and time consuming if the piece of equipment or machinery located on the tabletop is heavy or otherwise difficult to reposition.

Another type of adjustable table is moved by hydraulic cylinders located underneath the tabletop that are activated by a hand crank hydraulic pump to raise and lower the tabletop. One disadvantage of the hydraulic adjustable table is that a hydraulic system including a hydraulic pump must be part of the table. Another disadvantage is that hydraulic cylinders and lines often leak and cause an unclean and hazardous environment when the hydraulic fluid accumulates on the floor where the operator of the machinery is standing. This hydraulic table is particularly undesirable in industries where a clean environment is a necessity, such as in the textiles industry.

Therefore, an adjustable table is desired that is easily adjusted in height and tilt to help prevent injury to a worker due to repetitive movements. Also, an inherently clean adjustable table is desired for operation in a production facility where the environment necessitates cleanliness.

SUMMARY OF THE INVENTION

In one embodiment, the present invention provides a pneumatically adjustable table for presenting a work surface and allowing the worker to vary the height of the work surface relative to the worker by using a compressed air supply. This adjustable table has a planar tabletop which defines a plane and has a work surface, a bottom surface, a front edge, a back edge, a left edge and a right edge. A generally vertical support member is provided for movement in a generally vertical direction. A pneumatic drive mechanism moves the support member at least in the upwardly direction and preferably in the up and down direction. The compressed air supply is supplied to the pneumatic drive mechanism through a conduit means. A control means controls this air supply through the conduit means for selectively causing the pneumatic drive mechanism to move the support member up and down. The support member is attached to the tabletop such that the tabletop will be raised and lowered in response to the control means.

In the preferred embodiment, the support member has a tube defining an interior, a first end and a second end. The second end is sealed with an airtight seal to prevent any leakage of the compressed air from the interior of the tube. A shaft is slidably disposed in the first end of the tube which is positioned in the tube by the pneumatic drive mechanism. A seal is provided at the first end of the tube to prevent the compressed air from the air supply from escaping the interior of the tube between the tube and the shaft.

In the preferred embodiment, a tilt member, attached to the support member and the tabletop, has a pivot arm that tilts the tabletop forward and backward thereby adjusting the work surface of the tabletop to various angles for performing various functions by the worker. The pivot arm is adjusted by an adjusting apparatus attached to the pivot arm and the support member.

In the preferred embodiment, a plurality of stabilizers are used to stabilize the tabletop. The stabilizers have a cylinder with an open and closed end and a rod slidably disposed in the cylinder's open end. The rod is attached to the tilt member parallel to the support member and adjusts to the position of the support member with respect to the tabletop.

Also in the preferred embodiment, a brake for locking the tabletop in position is provided which is pneumatically controlled.

In the preferred embodiment an adjustable foot treadle for use in activating machinery is located underneath the tabletop. The foot treadle has first and second rods disposed parallel to each other with the first rod attached to the foot treadle and the second rod attached to the machinery located on the tabletop. When the tabletop height is adjusted, the second rod slides with respect to the first rod thereby adjusting the distance between the foot treadle and the tabletop. A pneumatic lock is used to lock the second rod with respect to the first rod when the tabletop height is in a desired position.

The height of the tabletop of the present invention is changed by actuating the control means. The control means then changes the air supply to the brake to unlock the tabletop. At the same time, the control means alters the air supply to the support means to raise or lower the tabletop. Also, the control means unlocks the pneumatic lock of the adjustable foot treadle to allow the second rod to slide, thereby following the changing position of the tabletop. Once the tabletop is at a desired height, the control means is released and the air supply to the support means is stabilized. At the same time, the control means locks the brake to maintain the tabletop in position and also locks the second rod of the foot treadle with the pneumatic lock. This allows the foot treadle to activate the machinery or apparatus on the tabletop.

Other objects and advantages of the invention will be apparent from the following description, the accompanying drawings and the appended claims.

DETAILED DESCRIPTION OF PREFERRED EMBODIMENT

Figure 12:
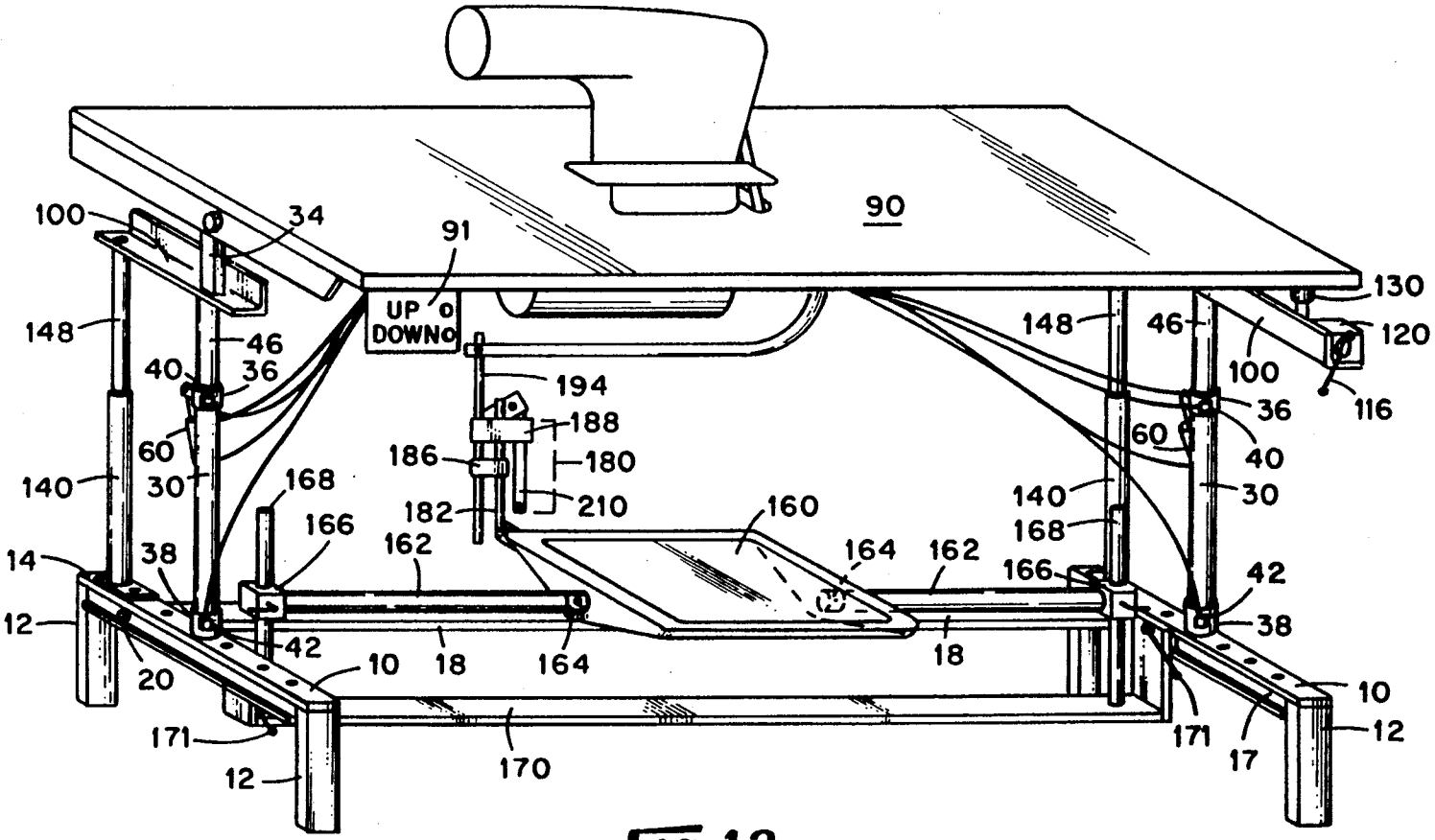
FIG. 12 shows the pneumatic adjustable table with stabilizers, pneumatic cylinders, base and foot treadle.

In FIG. 12 there is shown the preferred embodiment of the pneumatic adjustable table of the present invention with a tabletop 90 attached to pneumatic cylinders 30. Stabilizers 140 are also attached to the tabletop 90 and base 10. The pneumatic cylinders 30 are attached to base 10 parallel the stabilizers 140. An adjustable foot treadle 160 is mounted between the legs 12 of the base 10 for activating any apparatus located on the tabletop 90. Adjustable link rod 182, rod block 186, rod adjusting plate 188 and machine rod 194 are adapted to adjust in overall length when the tabletop 90 height is changed.

Figure 1:
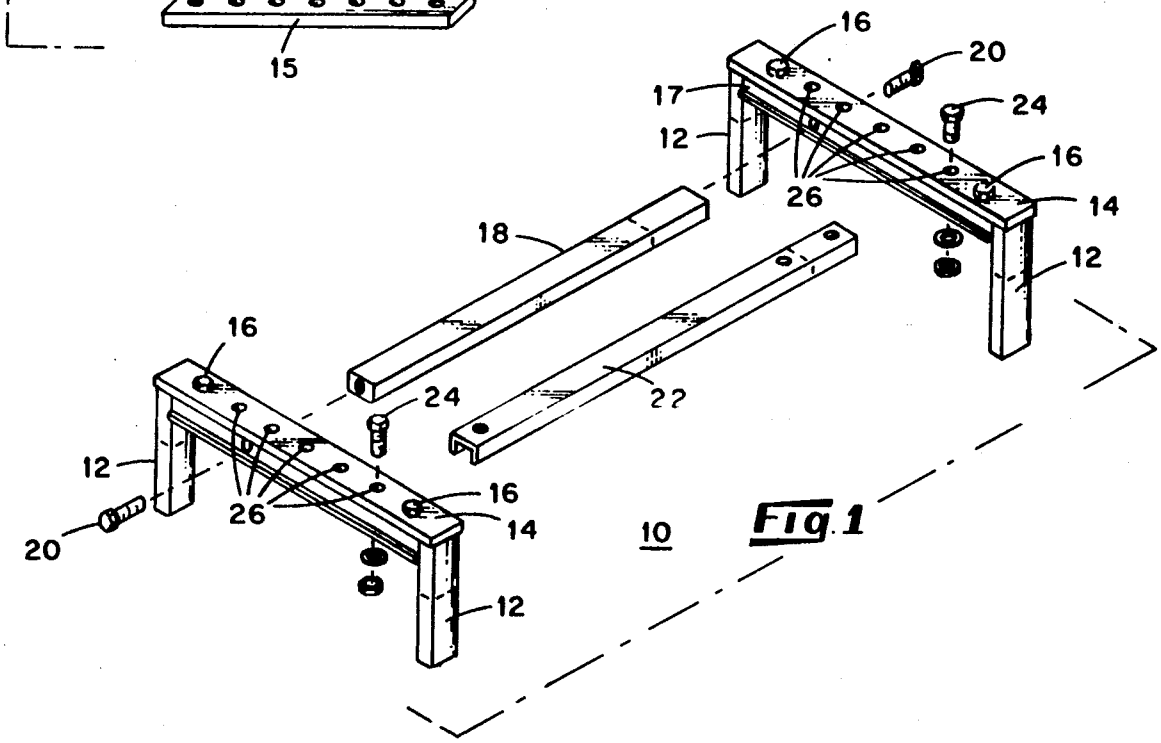
FIG. 1 shows the base of the pneumatic table disassembled.
Figure 2:
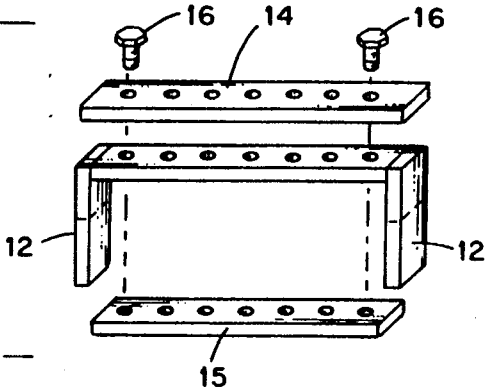
FIG. 2 shows the legs of the base disassembled.

Referring now more particularly to the drawings, in FIG. 1 and FIG. 2 there is shown the base 10 with legs 12 attached to the top mounting bar 14 and bottom mounting bar 15 with bolts 16. The top 14 and bottom 15 mounting bars are wider than the legs 12. This provides a channel 17 between the top 14 and bottom 15 mounting bars with leg 12 being the bottom of the channel 17 and the top 14 and bottom 15 mounting bars defining the sides of the channel 17. A cross member 18 is attached perpendicular to each leg 12 with bolts 20. Mounted parallel to the cross member 18 and to each leg 12 with bolts 24 is a channel brace 22. Adjustments can be made to the channel brace 22 by moving the brace 22 and bolts 24 to various positions defined by holes 26 in legs 12. The channel 17 between the top 14 and bottom 15 mounting bars provides a means to mount a foot treadle for activating any apparatus located on the table (not shown). This will be discussed in more detail below.

Figure 3:
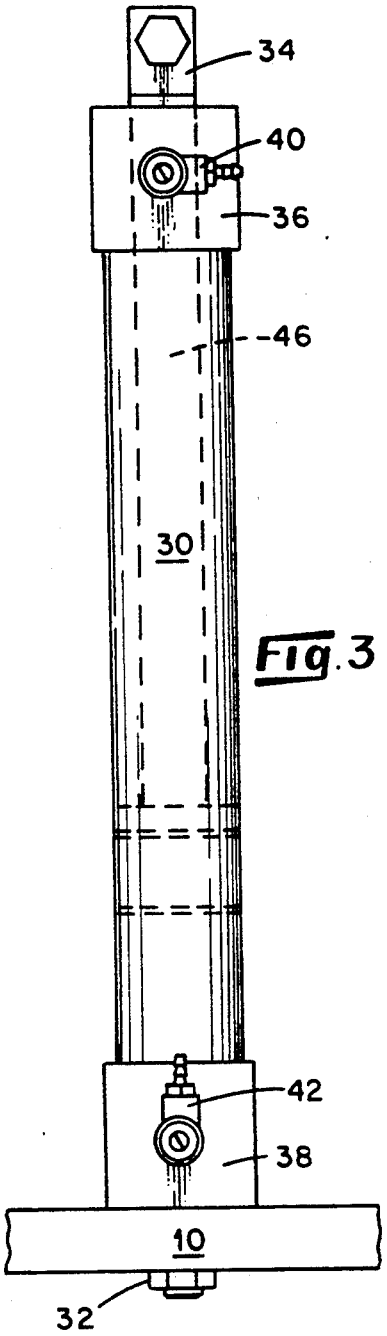
FIG. 3 shows a pneumatic cylinder of the pneumatic adjustable table.

In FIG. 3 there is shown a pneumatic cylinder 30 with the bottom cap 38 attached perpendicular to base 10 with stud and bolt 32. The base 10 provides a sturdy means to mount the pneumatic cylinder 30. The pneumatic cylinder 30 has a mounting bracket 34 attached to the top cap 36. Flow controls 40 and 42 are disposed in the top cap 36 and the bottom cap 38 of said pneumatic cylinder 30 to control the vertical extension of the pneumatic cylinder shaft 46 (shown in phantom) with air pressure.

Figure 5:
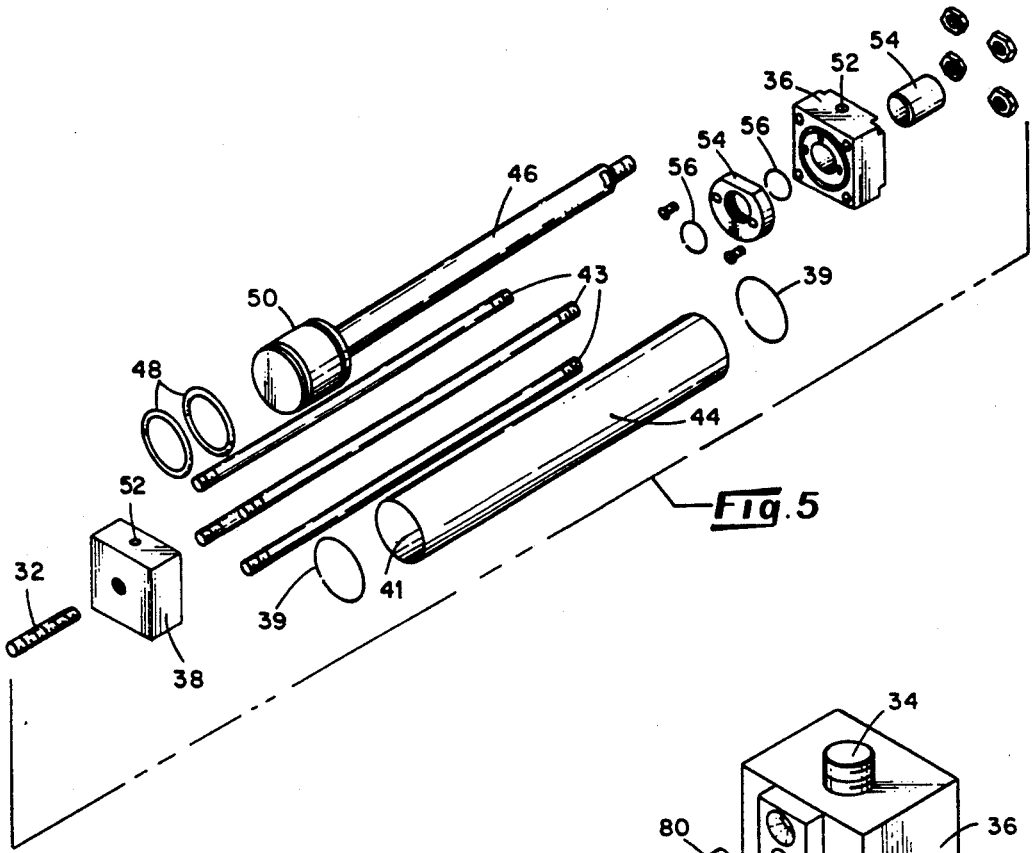
FIG. 5 shows the pneumatic cylinder disassembled.

FIG. 5 shows a pneumatic cylinder 30 unassembled. The top cap 36 and bottom cap 38 are attached to each end of the tube 44 with rods 43. 0-rings 39 are placed at each end of tube 44 to seal the top 36 and bottom 38 caps to the tube 44. Inside the tube 44, the shaft 46 is slidably disposed allowing it to move freely in the interior 41 of the tube 44. Seals 48 are used to seal the piston 50 of the shaft 46. These seals 48 provide an airtight seal allowing the air pressure entering or exiting holes 52 to vertically force the shaft 46 up and down in the interior of the tube 44. Bushings 54 and seals 56 in the top cap 36 provide an airtight seal around the shaft 46 when the shaft 46 and piston 50 slide vertically in the tube 44.

Figure 4:
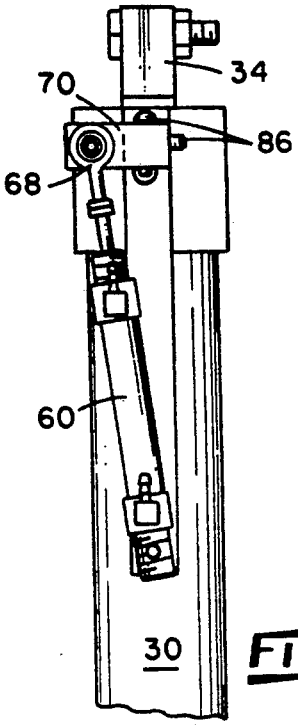
FIG. 4 shows a pneumatic brake attached to the pneumatic cylinder.
Figure 6:
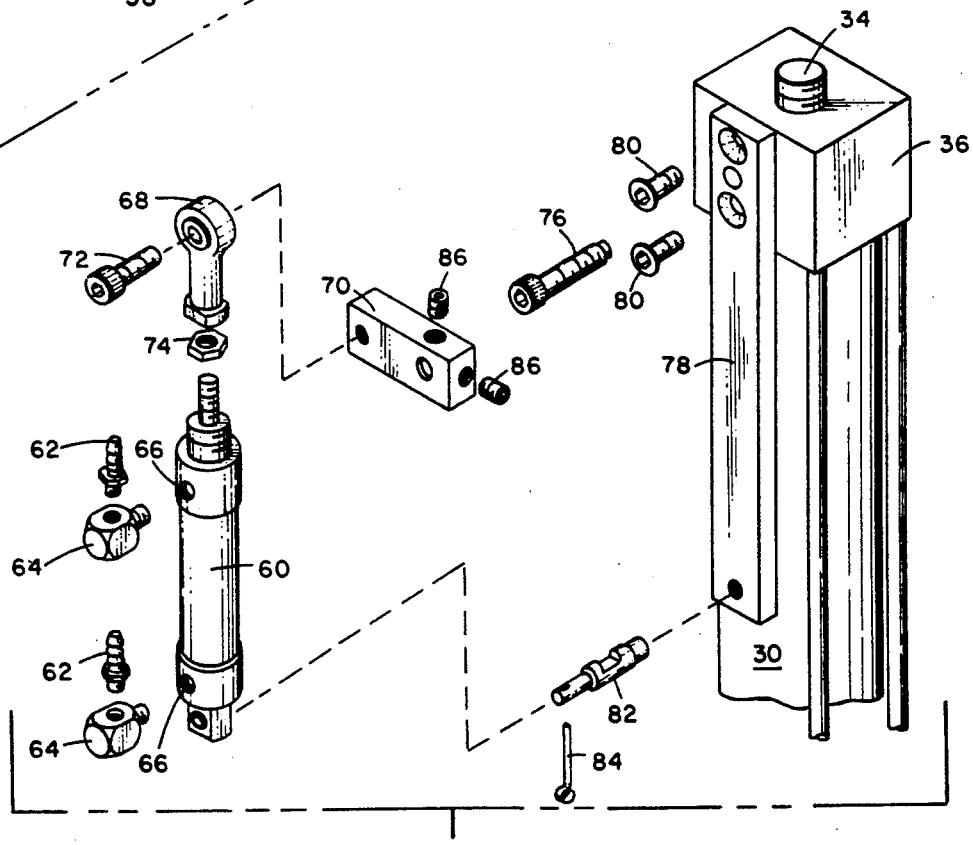
FIG. 6 shows the pneumatic brake disassembled from the pneumatic cylinder.

In FIG. 4 there is shown a brake 60 attached generally parallel to the pneumatic cylinder 30. The brake 60 is engaged when the pneumatic cylinder 30 is positioned to locate the tabletop at a desired height. FIG. 6 shows the pneumatic brake 60 disassembled with barb fittings 62 and L-fittings 64 disposed in holes 66 to provide a means to increase and decrease the air pressure inside the brake 60 thereby engaging and disengaging the brake 60. The brake 60 is attached to mounting bushing 68 by screwing the mounting bushing 68 onto the brake 60 and locking the bushing 68 with jamming nut 74. Mounting bushing 68 is attached perpendicular to lock lever 70 with cap screw 72. The lock lever 70 is perpendicularly attached into the pneumatic cylinder 30 with brake screw 76 which is held in place in the lock lever 70 with set screws 86. The cylinder arm 78 is attached parallel to the pneumatic cylinder's 30 top cap 36 with flat head screws 80. The bottom of the pneumatic brake 60 is attached to the end of the cylinder arm 78 with stud 82 and cotter pin 84. This allows the pneumatic brake 60 to rotate about stud 82.

Referring to FIG. 4 and FIG. 6, the pneumatic cylinder 30 is locked into position by the pneumatic brake 60 due to air pressure entering the pneumatic brake 60 through fitting 64 which extends the mounting bushing 68 upwards. The mounting bushing 68 rotates lock lever 70 thereby turning brake screw 76 into the top cap 36 of the pneumatic cylinder 30, locking the shaft 46 (FIG. 5) in place inside the pneumatic cylinder 30.

Figure 7:
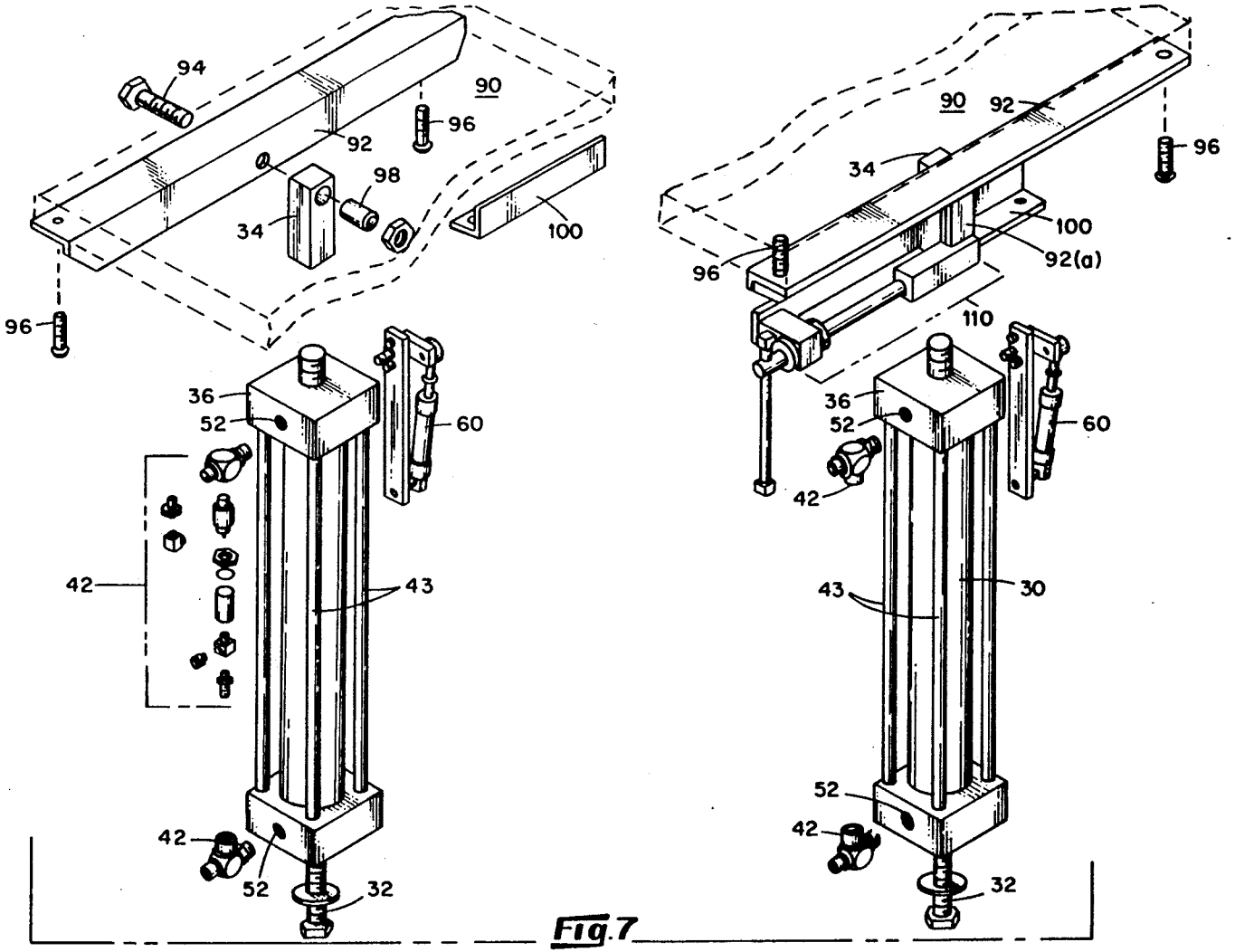
FIG. 7 shows the pneumatic cylinders disassembled from the tabletop with the pneumatic brakes and the adjusting apparatus.

In FIG. 7 there is shown pneumatic cylinders 30 with locking brakes 60 disassembled from the tabletop 90 (shown in phantom). Tilt members 92 are attached parallel to the tabletop 90 with bolts 96. A bolt 94 attaches the tilt members 92 to the mounting brackets 34 and defines the center axis of the table 90. A bushing 98 is used around bolt 94 to allow the table 90 to pivot about its center axis. A stabilizing member 100 is disposed generally parallel to the tabletop 90 between the mounting bracket 34 and the pneumatic cylinder's 30 top cap 36. Adjusting apparatus 110 is attached to stabilizing member 100.

Figure 8:
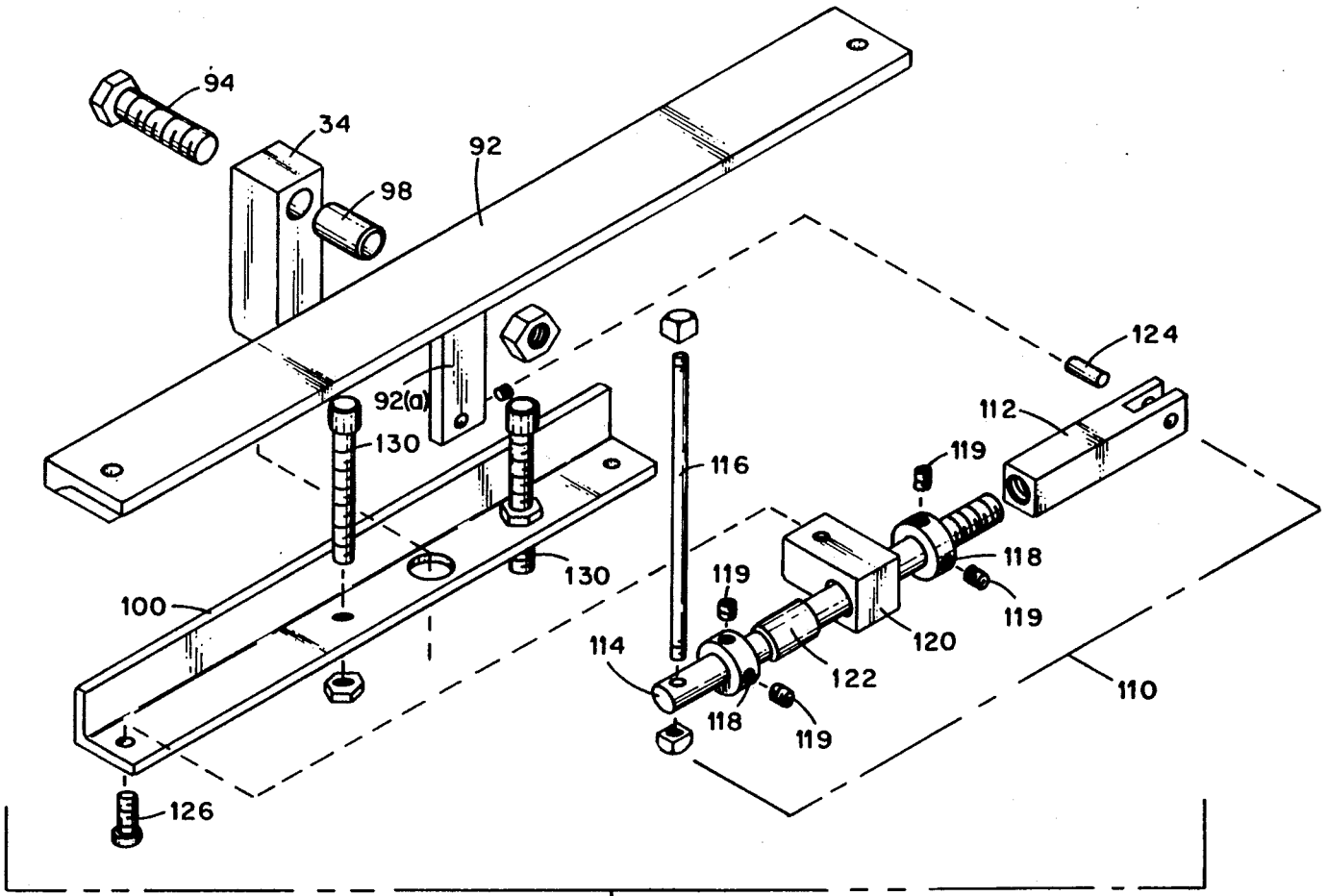
FIG. 8 shows the adjusting apparatus disassembled from the tilting member.

Referring now to FIG. 8 there is shown the adjusting apparatus 110 disassembled. The adjusting apparatus 110 comprises a tilt shaft 114 with tilt handle 116 attached perpendicular to one end of the tilt shaft 114 for turning the tilt shaft 114. Bushing block 120 and cap screw 126 are used to mount the tilt shaft 114 parallel to the stabilizing member 100. The bushing block 120 has a bushing 122 that allows the tilt shaft 114 to move freely inside the bushing block 120. Collars 118 attached to the tilt shaft 114 with set screws 119 are used to maintain the tilt shaft 114 in the proper position in said bushing block 120 and to prevent the tilt shaft 114 from exiting the bushing block 120.

Attached to the other end of the tilt shaft 114 is tilt clevis 112. The tilt clevis 112 is pivotally attached perpendicular to the pivot arm 92(*a*) with pin 124. The tilt shaft 114 can be screwed in and out of the tilt clevis 112 with the handle 116 thus moving pivot arm 92(*a*) vertically and rotating the tabletop 90 about the tabletop's 90 center axis defined by bolt 94. This tilts the tabletop 90 forward and backward. This allows the front and back edges of the tabletop to rotate, approximately 15° either way, in an arc about the center of the tabletop 90. Stop rods 130 are provided to prevent the tabletop 90 from tilting too far forward or backward and to maintain tabletop 90 in position.

Figure 9:
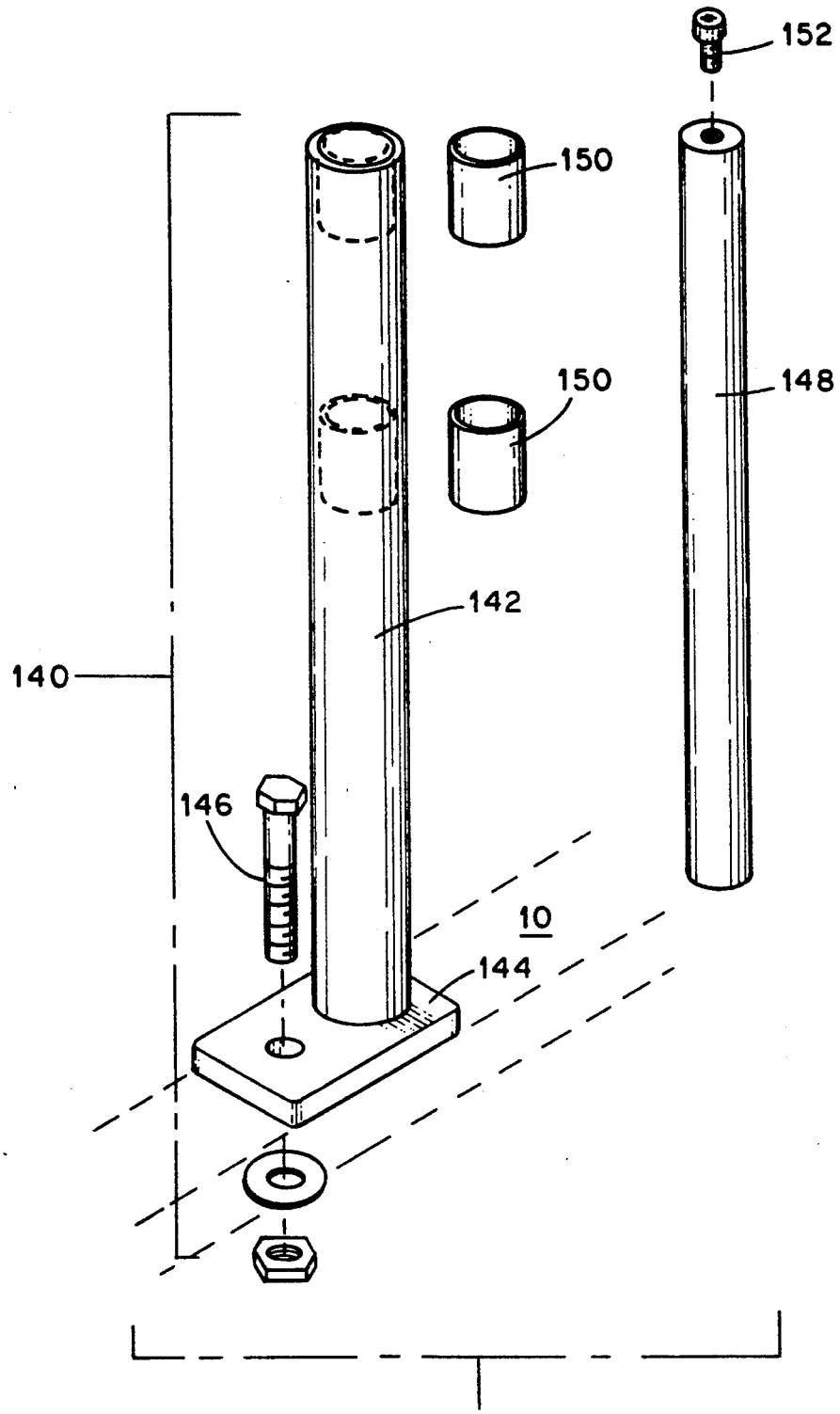
FIG. 9 shows a stabilizer disassembled.

Now referring to FIG. 9 there is shown a stabilizer 140 comprising a cylinder 142 mounted perpendicular to a plate 144. The plate 144 is mounted parallel to the base 10 (shown in phantom) with bolt 146. A rod 148 is slidably and vertically disposed in the cylinder 142 with bushings 150 located inside the cylinder 142. The bushings 150 provide a snug fitting of the rod 148 inside the cylinder 142 allowing the rod 148 to be stable in every vertical position inside the cylinder 142. The top of the rod 148 is mounted perpendicular to the stabilizing member 100 (FIG. 11) with bolt 152. The stabilizer 140 stabilizes the tabletop 90 and facilitates the supporting of the tabletop 90.

Figure 10:
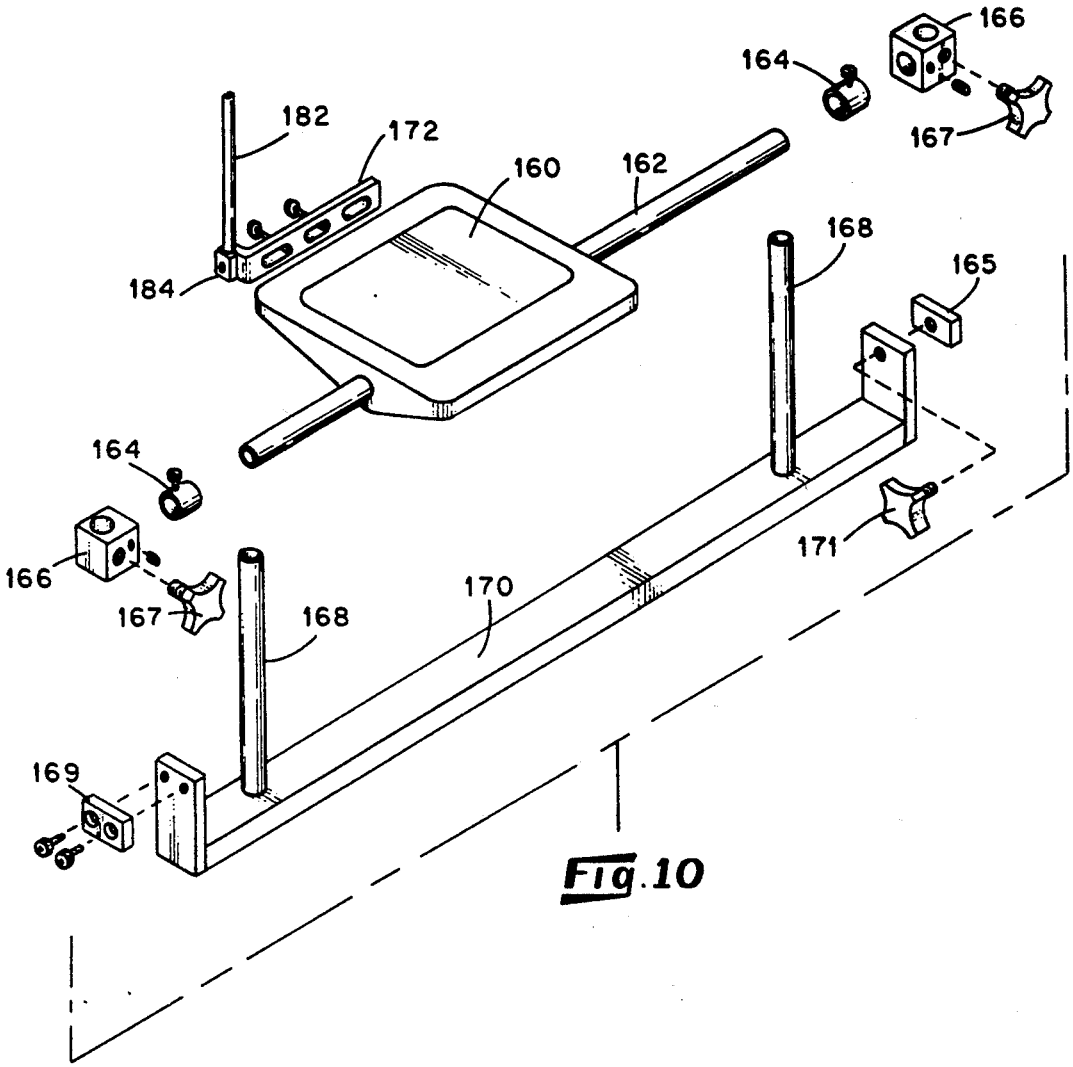
FIG. 10 shows the adjustable foot treadle assembly.

In FIG. 10 there is shown the foot treadle 160 disassembled. The foot treadle 160 is slidably mounted on a foot treadle rod 162 and held in position horizontally with collars 164. The foot treadle rod 162 is perpendicularly disposed in two rod collars 166 that are slidably mounted on vertical shafts 168. Knob studs 167 are used to lock foot treadle rod 162 in position on vertical shafts 168. Vertical shafts 168 are mounted to a foot treadle support member 170 which is attached to the slide plate 169 and lock plate 165. Plates 169 and 165 slide in channel 17 of base 10 FIG. 1. Knob stud 171, which is screwed into lock plate 165 is used to lock treadle support member 170 in position in channel 17 FIG. 1. The mounting of the foot treadle 160 on the foot treadle rod 162, vertical shafts 168 and foot treadle support member 170 allows the foot treadle 160 to be adjusted vertically, horizontally, forward and backward to a desired position for operation of the apparatus on the table. Attached to the foot treadle 160 is an extension 172 and adjustable link rod 182. Rod end 184 allows adjustable link rod 182 to rotate about rod end 184.

Figure 11:
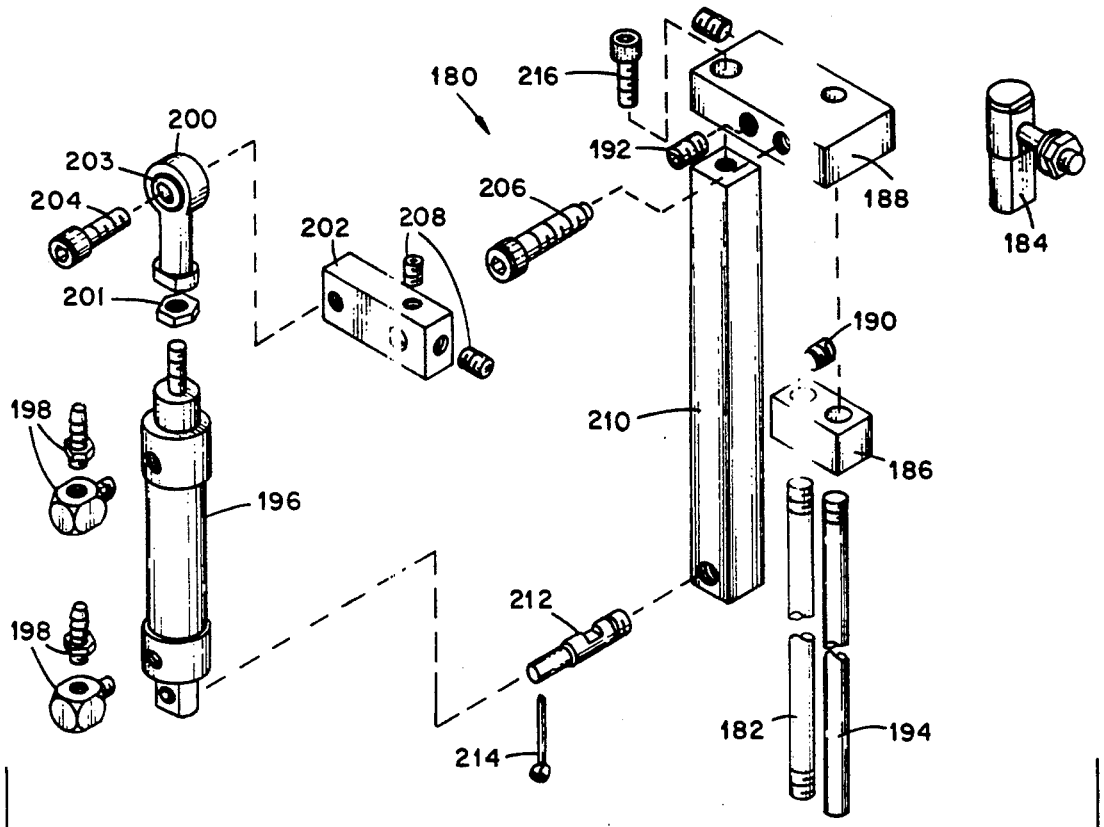
FIG. 11 shows the pneumatic lock of the adjustable foot treadle.

Referring now to FIG. 11 there is shown the pneumatic lock 180 for the adjustable link rod 182 of the foot treadle 160. The adjustable link rod 182 is attached generally perpendicular to the foot treadle 160 (FIG. 10) with rod end 184. Rod end 184 allows the adjustable link rod 182 to rotate, thereby moving freely when the treadle 160 is pressed. Adjustable link rod 182 is perpendicularly mounted through rod block 186 and into rod adjusting plate 188. Set screws 190 and 192 hold adjustable link rod 182 in the rod block 186 and the rod adjusting plate 188. A machine rod 194 is slidably mounted perpendicular to adjustable link rod 182 through the rod block 186 and rod adjusting plate 188. A pneumatic lock 196 is shown with air pressure inlet and outlet nozzles 198 disposed in the top and bottom of the pneumatic lock 196. A rod end bushing 200 is mounted to the pneumatic lock 196 by screwing the bushing 200 onto the pneumatic lock 196 and securing it with locking bolt 201. Bushing 200 is mounted perpendicular to a lock lever 202 with bolt 204. A bushing 203 inside the bushing 200 allows the pneumatic lock 196 to rotate about the bolt 204. The lock lever 202 is attached to the locking bolt 206 and held in place with set screws 208. The locking bolt 206 is disposed through the rod adjusting plate 188. The pneumatic lock 196 is attached generally parallel to the lock arm 210 with lock pin 212. A cotter pin 214 holds the pneumatic lock 196 onto said lock pin 212 and allows the pneumatic lock 196 to rotate about the lock pin 212. The lock arm 210 is mounted to the rod adjusting plate 188 with bolt 216.

Referring to FIGS. 11 and 12, when the tabletop 90 is moved up or down, the pneumatic lock 196 is released by increasing the air pressure to the top of pneumatic lock 196 which lowers bushing 200 thereby rotating lock lever 202 and unscrewing lock bolt 206. This releases the machine rod 194 attached to the machine on the tabletop 90. The machine rod 194 slides through the rod adjusting plate 188 thereby self-adjusting. When the tabletop 90 is in position, the pneumatic lock 196 locks the machine rod 194 into place in the rod adjusting plate 188. This is done by air pressure entering the lower portion of lock 196, extending bushing 200 which rotates lock lever 202 and screws lock bolt 206 into the machine rod 194 locking it in place. The machine can then be activated with the treadle 160 through the adjustable link rod 182 and the machine rod 194.

The tabletop 90 in FIG. 12 is moved up or down by pressing switches 91. Switches 91 activate a pneumatic control system located underneath the table. Constant air pressure is maintained on both ends of the pneumatic cylinders 30 through flow control valves 40 and 42 to maintain the tabletop 90 in position. When the up switch 91 is depressed, air pressure is exhausted in the upper portions of pneumatic cylinders 30 through flow control valves 40 and air pressure is maintained in the lower portion of pneumatic cylinders 30 through flow control valves 42. At the same time, the air pressure to the upper portions of the pneumatic brakes 60 and pneumatic lock 180 is increased to disengage brakes 60 and pneumatic lock 180. The exhausting of air pressure in pneumatic cylinder's 30 upper portion raises the tabletop 90. The air pressure being exhausted out of cylinders 30 is metered to control the raising and lowering speed of the tabletop 90. The speed of cylinders 30 is controlled through the flow control valves 40 and 42 in the top 36 and bottom 38 end caps of cylinders 30.

Once the tabletop 90 reaches the desired height, the up switch 91 is released and the air pressure to the pneumatic cylinders 30 is maintained. Also, air pressure to the lower portion of air brakes 60 and pneumatic lock 180 is increased, thus engaging the air brakes 60 on the pneumatic cylinder 30 and engaging pneumatic lock 180 on the machine rod 194 locking it in place.

If the tabletop is lowered, the down switch 91 is depressed thereby exhausting the air pressure in the lower portion of the pneumatic cylinders 30 through flow control valves 42 and maintaining the air pressure in the upper portion of the pneumatic cylinders 30 through flow control valves 40. At the same time, the pneumatic brakes 60 and pneumatic lock 180 are disengaged allowing the lowering of tabletop 90. Once the tabletop 90 is at a desired position, the pneumatic cylinders 30 are locked in place and the machine rod 194 is locked in place as stated above.

Figure 13:
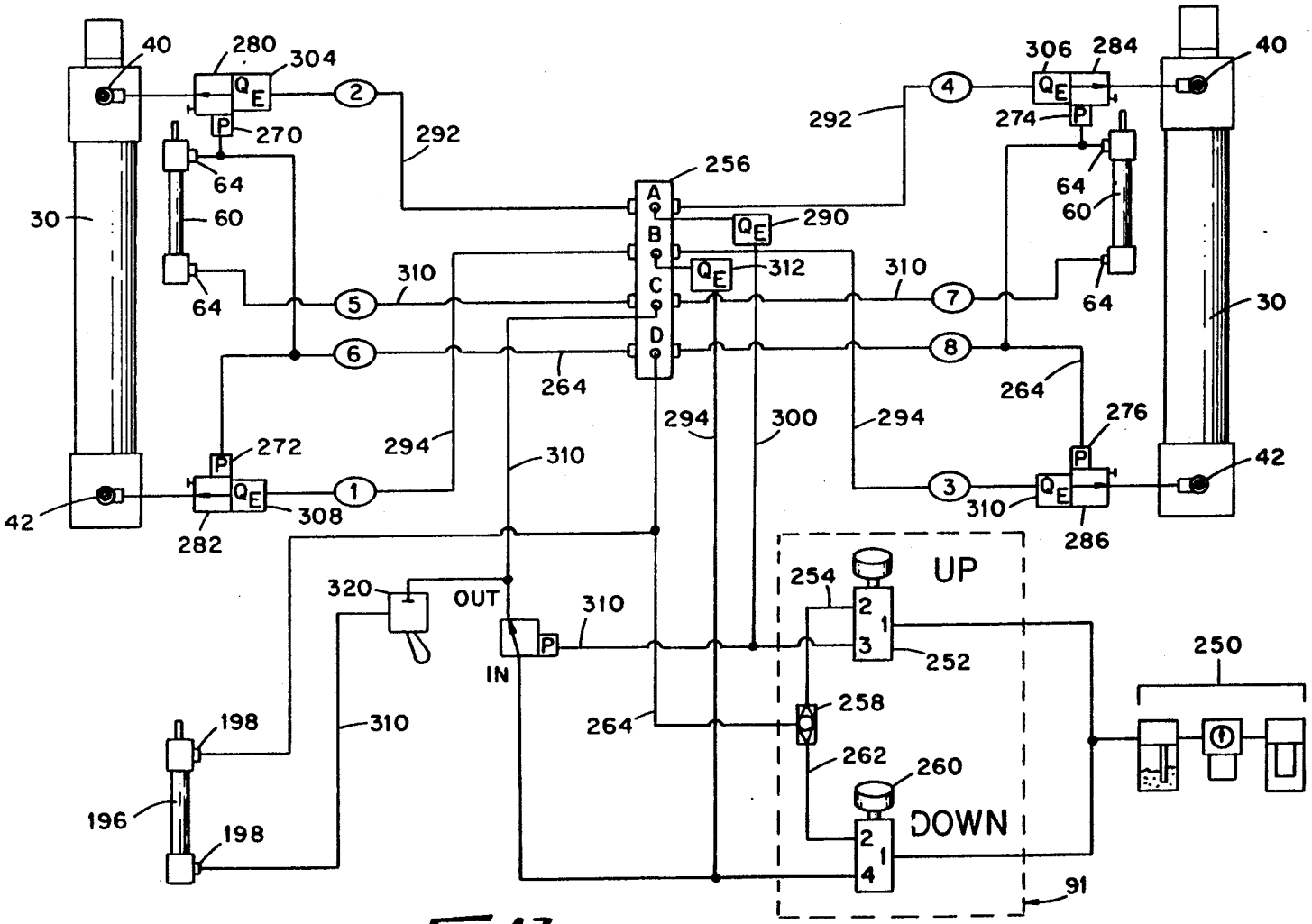
FIG. 13 shows the pneumatic control system.

In FIG. 13 there is shown the pneumatic system for controlling the raising and lowering of tabletop 90. Air pressure regulator 250 is used to maintain a constant pressure, preferably 60 to 80 psi, to the pneumatic system. The air supplied to the pneumatic system is from any factory air supply inside the factory. Most factories have air supply lines located throughout to run various machinery. This provides a convenient air supply for the present invention.

The tabletop 90 is maintained in a position by constant air pressure to both top and bottom portions of pneumatic cylinders 30 through flow control valves 40 and 42. This provides a stable positioning and smooth repositioning of the tabletop 90.

The tabletop 90 is raised by pressing up valve 252 which is a four way valve. Valve 252 releases the brakes 60 and lock 180 through line 264 which is attached to manifold 256 at its D portion. A shuttle valve 258 is used to isolate line 254 and valve 252 from the down valve 260 and line 262. The air pressure is increased through line 254 through shuttle valve 258 and line 264. This increase in pressure drives the pilots 270, 272, 274 and 276 of the interlock valves 280, 282, 284 and 286. Valves 280, 282, 284 and 286 provide an air lock to pneumatic cylinders 30 which maintain constant pressure to the top and bottom of cylinders 30 and keep the tabletop in position if the air supply to the pneumatic system is lost. The interlock valves 280, 282, 284 and 286 are normally closed when no pressure is applied to pilots 270, 272, 274 and 276. By applying pressure to pilots 270, 272, 274 and 276, the pilots actuate interlock valves 280, 282, 284 and 286 and open the interlock valves 280, 282, 284 and 286.

The brakes 60 and lock 196 are released by the application of pressure to the top portion of brakes 60 and lock 196 through line 264. This pressure will force the brakes 60 and lock 196 to retract, thus unlocking cylinders 30 and the adjustable link rod 182.

At the same time, the pressure to the top of cylinders 30 is exhausted by the quick exhaust valve 290, since the interlock valves 280 and 284 are open. The air pressure is exhausted out of quick exhaust valves 304 and 306 and through lines 292, manifold 256 and quick exhaust valve 290. The pressure to the lower portion of cylinders 30 is maintained through lines 294 since interlock valves 282 and 286 are open. The maintaining of pressure in the lower portion and exhausting of pressure from the upper portion of cylinders 30 raises the tabletop 90.

When the tabletop 90 reaches a height that is desirable, the up valve 252 is released. The pressure through line 264 is exhausted through valve 252, thereby inactivating the pilots 270, 272, 274 and 276. The interlock valves 280, 282, 284 and 286 are closed thereby locking the air pressure inside cylinders 30. The cylinders 30 will be in position once the pressure on both sides of the piston 50 inside cylinder 30 is equal. At the same time, the pressure in line 310 increases thus extending brakes 60 and lock 196. Brakes 60 and lock 196 mechanically lock the cylinders 30 and adjustable link rod 182 in place.

The use of interlock valves 280, 282, 284 and 286 and mechanical brakes 60 provides a dual locking system for maintaining the position of the tabletop.

The tabletop is lowered by depressing the down valve 260. As stated above, the air pressure is increased on line 264, through line 262 and shuttle valve 258. The increase in pressure activates pilots 270, 272, 274 and 276 opening interlock valves 280, 282, 284 and 286. The brakes 60 and lock 196 are released by the pressure through line 264 forcing the brakes 60 and lock 196 to retract.

At the same time, the air pressure to the lower portion of cylinders 30 is exhausted through quick exhaust valves 312, 308 and 310. The air pressure to the upper portion of cylinders 30 is maintained through lines 292 and 300 since interlock valves 280 and 284 are open, but quick exhaust valves 290, 304 and 306 are not activated.

Once the tabletop is in position, valve 260 is released. The pressure through line 264 is exhausted through valve 260 thereby inactivating the pilots 270, 272, 274 and 276. The interlock valves 280, 282, 284 and 286 are closed, thus locking the air pressure inside cylinders 30. The cylinders 30 will be in position once the pressure in the upper and lower portions of the cylinders 30 is equal. As stated above, the pressure in line 310 increases thus extending brakes 60 and lock 196, thus locking the tabletop 90 and the adjustable link rod 182.

The lock 196 for the adjustable link rod 182 can be disengaged in order to manually adjust the foot treadle 160 without repositioning the tabletop 90. Toggle 320 is used to release lock 196. Once toggle 320 is switched, the air pressure on line 264 must be increase to disengage lock 196. This is done by bumping either the up 252 or down 260 valve. This bumping will not be sufficient enough to cause the table to move but will disengage lock 196. Once the foot treadle is in position, the toggle 320 is switched back, thereby increasing pressure in line 310 locking lock 196. This locks the adjustable link rod 182 of the foot treadle 160 so the apparatus on the tabletop 90 can be activated by the foot treadle 160.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A pneumatically adjustable table for presenting a work surface and allowing a worker to vary the height of the work surface relative to the worker by using a compressed air supply, comprising:

a generally planar tabletop defining a plane having an orientation with respect to horizontal and having a work surface, a bottom surface, a front edge, a back edge, a left edge and a right edge;

a generally vertical support member disposed for movement in a generally vertical direction, up and down;

a pneumatic drive mechanism for moving said support member at least in an upwardly direction;

conduit means for supplying compressed air from the air supply to said pneumatic drive mechanism;

control means for controlling the supply of air from the air supply to said conduit means for selectively causing the pneumatic drive mechanism to move to support member; and means for attaching said support member to said tabletop said tabletop moveable between at least raised and lowered positions by said support member in response to said control means, said plane defined by said tabletop substantially maintaining said orientation with respect to horizontal in said raised and lowered positions;

said table further comprising an adjustable foot treadle system for use in manipulating an apparatus located on said tabletop that adjusts to changes in said tabletop height, said adjustable foot treadle system comprising:

a foot treadle;

a first rod having first and second ends and a length;

a second rod having first and second ends and a length, disposed parallel to said first rod, said first rod attached to said foot treadle at said first end, said second end of said first rod extending upwardly toward said tabletop, said length of said first rod insufficient for said second end of said first rod to each said tabletop and said first end of said second rod extending downwardly, parallel to said first rod, toward said foot treadle, said second end of said second rod extending upwardly, beyond said second end of said first rod, and connected to the apparatus located on said tabletop; and an adjustable linkage means attached to said first rod and slidably disposed to said second rod for allowing the second rod to slidably adjust without changing position of said foot treadle and for locking said first and second rods in place.

2. A pneumatically adjustable table for presenting a work surface and allowing a worker to vary the height of the work surface relative to the worker by using a compressed air supply, comprising:

a generally planar tabletop defining a plane having an orientation with respect to horizontal and having a work surface, a bottom surface, a front edge, a back edge, a left edge and a right edge;

a generally vertical support member disposed for movement in a generally vertical direction, up and down;

a pneumatic drive mechanism for moving said support member at least in an upwardly direction;

conduit means for supplying compressed air from the air supply to said pneumatic drive mechanism;

control means for controlling the supply of air from the air supply to said conduit means for selectively causing the pneumatic drive mechanism to move the support member; and means for attaching said support member to said tabletop said tabletop moveable between at least raised and lowered positions by said support member in response to said control means, said plane defined by said tabletop substantially maintaining said orientation with respect to horizontal in said raised and lowered positions;

said table further comprising an adjustable foot treadle that adjusts to changes in said tabletop height for use in actuating a piece of machinery located on said tabletop, said adjustable foot treadle comprising:

a foot treadle;

a first rod connected to said foot treadle, having first and second ends, said first end connected to said foot treadle and said second end extending upwardly toward said tabletop, said first rod having a length insufficient for said second end to contact said tabletop;

a second rod disposed parallel to the first rod said second rod having first and second ends, said first end of said second rod extending downwardly, parallel to said first rod, toward said foot treadle, said second end of said second rod extending upwardly toward said tabletop, beyond second end of said first rod and connected to the machinery, said second rod having a length insufficient for said first end of said second rod to contact said foot treadle;

adjustable linkage means including a pneumatic air lock attached to said first rod and slidable disposed to said second rod for allowing said second rod to slide relative to said first rod when said tabletop is moved without moving said foot treadle; and said pneumatic look unlocking said second rod thereby allowing said second rod to slide through said adjusting apparatus and said pneumatic lock locking said second rod in place.

3. An adjustable foot treadle system for use in activating machinery on a work table movable upwardly and downwardly comprising:

a foot treadle;

a first rod having first and second ends and a length, and a second rod having first and second ends and a length disposed parallel to each other, said first ends of said first rod attached to said foot treadle and said second end of said first rod extending upwardly from said foot treadle toward said tabletop, said length of said first rod insufficient for said second end of said first rod to contact said tabletop and the second end of said second rod attached to the machinery, said first end of said second rod extending downwardly toward said foot treadle, said length being insufficient for said first end of said second rod to contact said foot treadle;

adjusting means attached to said first rod and slidably disposed to said second rod for allowing said second rod to slide relative to said first rod when said tabletop is moved without moving said foot treadle comprising:

lock means for locking said second rod into place and for unlocking said second rod thereby allowing said second rod to slide;

control means for controlling said lock means; and said lock means unlocking said second rod in response to said control means to allow the second rod to slide through said adjusting apparatus thereby allowing the height of the work table to be adjusted.

* * * * *